United States Patent [19]

Rosselet

[11] 4,134,555

[45] Jan. 16, 1979

[54] WASTE DISPOSER

[76] Inventor: Charles R. Rosselet, 14004 Palawan Way, Marina Del Rey, Calif. 90291

[21] Appl. No.: 762,456

[22] Filed: Jan. 25, 1977

[51] Int. Cl.[2] ..... B02C 18/42

[52] U.S. Cl. ..... 241/46 B; 241/46.08; 241/100.5; 241/195; 241/191

[58] Field of Search ..... 241/46 A, 46 B, 46.08, 241/46.11, 100.5, 194, 195, 257 A

[56] References Cited

U.S. PATENT DOCUMENTS

| | | | |
|---|---|---|---|
| 2,573,213 | 10/1951 | Miller | 241/100.5 |
| 2,784,915 | 3/1957 | Gordon | 241/46.08 |
| 2,912,176 | 11/1959 | Jordan | 241/46.08 |
| 3,188,012 | 6/1965 | Shive et al. | 241/46 B |
| 3,439,878 | 4/1969 | Reaux | 241/195 |

*Primary Examiner*—Granville Y. Custer, Jr.
*Attorney, Agent, or Firm*—Mark C. Jacobs

[57] ABSTRACT

An improved waste disposer having shredding means in a comminution chamber and a rotor rotatable within the chamber. Freely rotating impellers are provided on the rotor which rotate as the rotor is rotated. Each impeller includes at least one main cutting blade adapted to co-operate with the shredding means to comminute waste in the chamber. Each impeller also includes one or more subsidiary cutting blades for assisting in grinding such waste. The blades on one impeller are mounted in a mirror image relationship to the blades on the other impeller to provide improved comminution of the waste.

15 Claims, 5 Drawing Figures

WASTE DISPOSER

BACKGROUND OF THE INVENTION

1. Field of the Invention

This invention relates to a waste disposal apparatus; and, more particularly, to an improved rotary impeller assembly in a waste disposal apparatus.

2. Description of the Prior Art

It is well known to provide food disposers with grinding lugs secured to a rotor and disposed to cooperate with a stationary grinding surface in the disposer for grinding and shredding waste materials and garbage. Efficient comminution of the materials is accomplished when the grinding lugs are rigidly and unyieldably secured to the rotor. Thus, it has been conventional to rigidly secure the lugs to the rotor and prevent any relative movement therebetween. Although disposers equipped with these stationary lugs achieve good grinding action, they redily become jammed when a substantially uncomminutable material, such as silverware, glass or the like, become lodged between the lug and the grinding surface. Each time such jamming occurs, the machine must be shut down until the hard material is dislodged.

The art then turned to the use of impellers which can either rotate 90°, 180° or 360°. In units wherein the impeller assembly rotates 90° or 180°, the rotary impeller assembly is subject to impact or shock loading of the rotor and impeller as the impeller moves between retracted and extended positions. As the impeller engages bones or other objects of waste material resisting comminution only by absorbing the impact, it is possible to try to eliminate the objectionable vibration resulting from the impact and the noise resulting from vibration of the operating unit. While free yielding lugs or hammers sacrifice some of the grinding efficiency of the fixed lugs, shut-downs are virtually eliminated. The need has been seen for a comminuting assembly which achieves the advantages of both the fixed and swingable types without the disadvantages of either. That is, an impeller that has the grinding capability of a fixed lug, in conjunction with the ease of unjamming of the rotatable impellers when abnormally hard or oversize objects are encountered by the waste grinder.

SUMMARY OF THE INVENTION

The present invention is directed toward an arrangement wherein the impellers of the disposer are freely rotatable about generally vertical axes as the rotor is rotated. While the discussion herein always relates to the disposition of two rotatably secured impeller mechanisms, no reason is seen that, space permitting, three or even more such impeller means could not be employed. The present invention will be seen to provide a low cost high efficiency impelling-grinding means.

Accordingly, it is an object of this invention to provide an improved comminuting assembly for a food waste disposer.

It is another object to provide improved impellers having blades rotatable about 360° to present a plurality of cutting edges to waste being comminuted.

It is a further object to provide a new impeller system wherein the impeller means include cutting blades which are mounted in a mirror image relationship on each impeller.

A still further object is to provide an improved impeller means in a waste disposer that both impels and grinds waste food.

Another object is to provide a plurality impeller means in a waste disposer apparatus with cutting surfaces on each impeller.

Yet another object of the invention is to provide an impeller with blades thereon that may be fabricated by casting, or may be fabricated from sheet metal in part and/or casting in part.

Operation of the device and further objects and advantages thereof will become evident as the description proceeds and from an examination of the accompanying drawings which illustrate a preferred embodiment of the invention and in which similar numerals refer to similar parts throughout the several views.

DESCRIPTION OF THE PREFERRED EMBODIMENT

Figure 1:
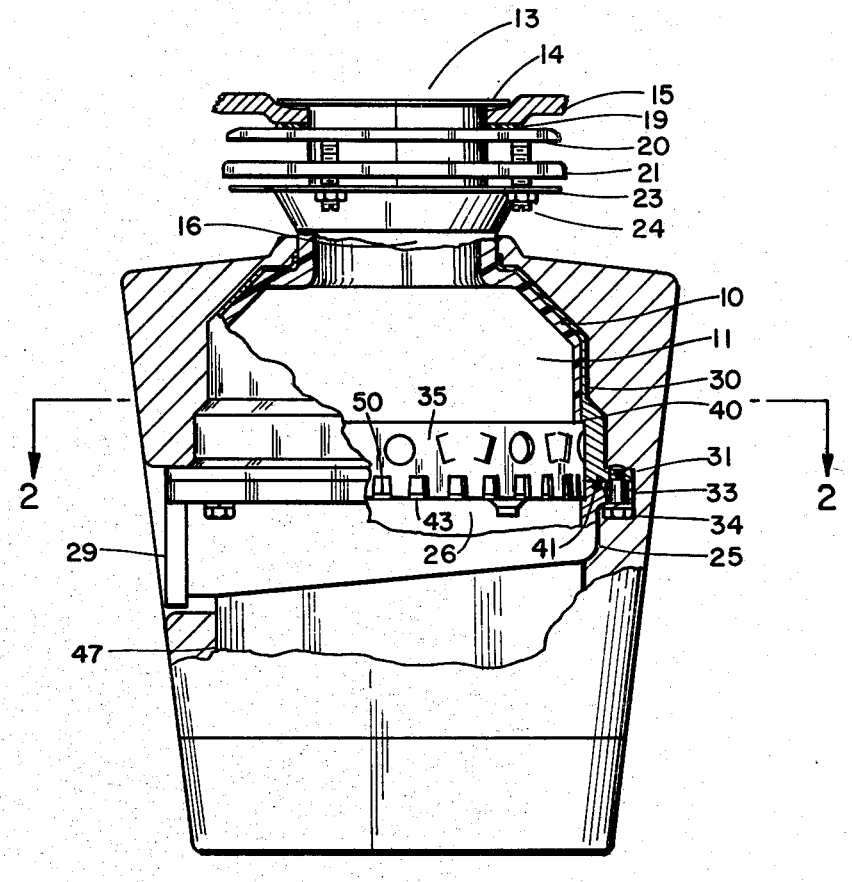
FIG. 1 is an over-all view of a waste disposer apparatus shown partially in section to illustrate a portion of the instant invention.

Referring now to FIG. 1 of the drawing, there is shown a generally cylindrical waste disposer having an upper housing 10 defining a comminution chamber 11 for accomodating waste material to be comminuted. The disposer includes an inlet 13 at its upper end for receiving the waste material. The inlet is formed at least in part by an inlet sleeve member 14 supportable in a drain opening of a sink 15 or the like. The inlet sleeve member 14 is connected to the inlet end 16 of the upper housing 10 through a supporting arrangement that may include a resilient sink gasket 19, upper and lower mounting plates 20 and 21, a housing clamping plate 23, an annular ring (not shown) for supporting the lower mounting plate 21 on the inlet sleeve member, and a plurality of mounting studs 24.

A lower housing 25 defines a discharge chamber 26 communicating with a fluid outlet 29 adapted to be coupled to a waste discharge line (not shown). The lower housing 25 is attached to the upper housing 10 through a housing 46 encompassing the lower portion of the upper housing 10 and having a flange 31 mating with a flange 33 of the lower housing 25. A plurality of bolts 34 join the mating flanges 31 and 33.

A substantially cylindrical annular shredder ring 35 is maintained in a relatively stationary position through the clamping action of the housing clamp 30 and the lower housing 25. The shredder ring 35 includes a plurality of spaced downwardly extending shredding elements 36 disposed about the periphery thereof. Prebreaking means 35' may be provided on the inner wall of ring 35 for assisting in breaking up waste, as will be discussed. Formed between the adjacent pairs of the downwardly extending elements 36 are channels 39 opening downwardly for accomodating the flow of fluid and comminuted waste material from the comminution chamber 11 toward the discharge chamber 26 and the outlet 29. The shredder ring 35 may engage and compress a sealing flange 40 at the lower end of the upper housing 10 and a sealing gasket 41 recessed into the upper flange of the lower housing 25 to seal the comminution chamber 11 and discharge chamber 26 from leakage through the connection at the mating flanges 31 and 33 of the housing clamp 30 and the lower housing 25.

A rotary impeller assembly 43 includes a rotor 44 attached to the motor shaft (not shown) for rotation therewith by means of a threaded aperture 44*a* (see FIG. 2) in rotor 44. Technically speaking aperture 44*a* is not seen in FIG. 2. What is really seen is a circular line designating the top thread of the nut 53*a* said aperture 44*a* being of equal dimension but beneath the nut 53*a*. As particularly contemplated in the present invention, the rotor 44 supports impeller means for effecting comminution of the waste material upon rotation of the rotor 44.

In the exemplary embodiment of the invention, such impeller means includes a plurality, such as a pair, of impellers 45, 46 (FIG. 2) cooperable with the downwardly extending elements 36 of the shredder ring 35 for effecting comminution of the waste material upon rotation of the rotor 44.

Figure 2:
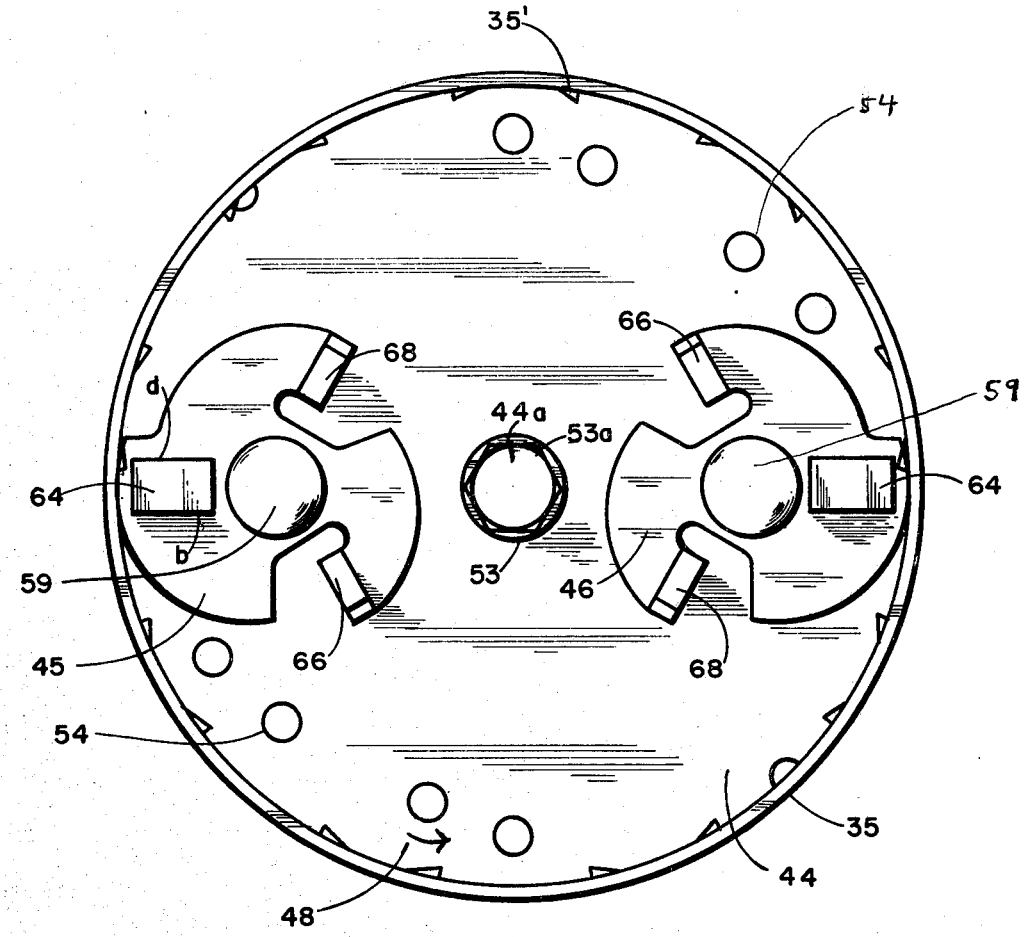
FIG. 2 is a horizontal sectional view of the waste disposer as taken substantially along line 2—2 of FIG. 1 and shows the rotary impeller assembly with rotatably operable impellers.

Attached to the lower portion of the lower housing 25 is a motor 47 for rotating the rotary impeller assembly 43 in a direction shown by the arrow 48 in FIG. 2 to effect comminution of waste material between the impellers 45, 46 and the shredder ring 35. Means (not shown) provide for selective energization of the motor 47.

The disc-like rotor 44 has an upper face 50 (FIG. 1) substantially forming a bottom for the comminution chamber 11 and a lower face 51 substantially forming the upper side of the discharge chamber 26 whereby the rotor 44 effectively serves as a divider between the comminution chamber 11 and the discharge chamber 26. The rotor 44 includes an upwardly extending centrally mounted hub 53 surrounding threaded aperture 44*a* attached to the motor shaft, as by a threaded engagement and coupled thereto by nut 53*a*, for effecting rotation of the rotor 44 by the motor 4. The outer diameter of the rotor 44 is established so that the periphery is closely spaced from the inner surface of the downwardly extending elements 36. The rotor 44 also includes a plurality of apertures or holes 54 for accomodating flow of fluid from the comminuting chamber 11 into the discharge chamber 26.

Figure 3:
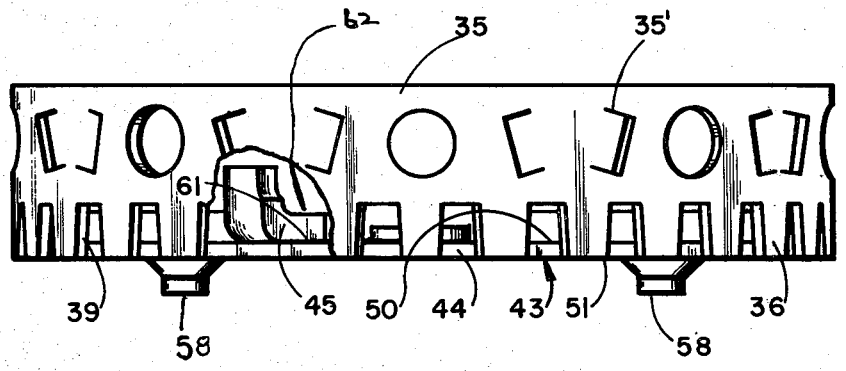
FIG. 3 is an elevational view of the portion of the disposer shown in FIG. 2.
Figure 6:
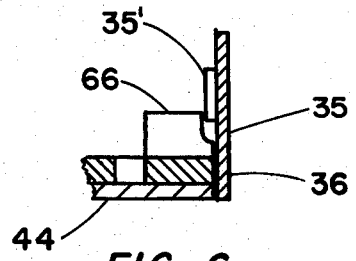

Although a pair of impellers 45, 46 are shown mounted on rotor 44, obviously more than two may be provided. Also, except as otherwise noted, the impellers are substantially identical. Thus, each impeller 45, 46 is mounted for free rotation on rotor 44 by means of a pin 58 (FIG. 3) extending upwardly through rotor 44 and through a suitable aperture in each impeller 45, 46 with a cap nut or plate 59 fixedly retaining each impeller 45, 46 on rotor 44 for free rotation thereon.

The impellers 45, 46 are preferably diametrically opposite each other on rotor 44 and, if more than two impellers are used, obviously such impellers would be spaced accordingly.

Each impeller 45, 46, as shown in FIG. 2, is mounted adjacent the outer portion of the rotor 44. The impellers 45, 46 are freely rotatable about pins 58 and rotate due to centrifugal force acting thereon upon rotation of rotor 44 by motor 47.

Figure 4:
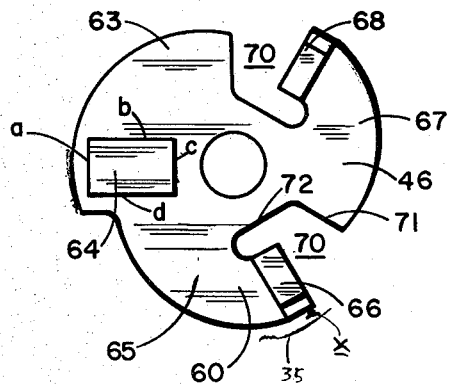
FIG. 4 is a top plan view of one of the impellers alone of the apparatus of FIGS. 1 through 3.

As shown in FIG. 4, impeller 45 is shown in plan view, and like comments with respect to impeller 45 apply to impeller 46 except where otherwise indicated. Thus, each impeller, as, for example, impeller 45, includes a main base plate 60 having a generally flat bottom surface 61 (see FIG. 1 or 3) adjacent the upper surface 50 of rotor 44 and a generally flat upper surface 62. The main base plate 60 includes a first base portion 63 having a main grinding or cutting blade 64 upstanding therefrom, a second base portion 65 having a first secondary grinding or cutting blade 66 and a third base portion 67 having a second secondary grinding or cutting blade 68. As shown in FIG. 4, each blade 64, 66 and 68 is generally rectangular in cross-section.

As the rotor 44 rotates in the direction of arrow 48 in FIG. 2, impeller 45 rotates in the same direction. Thus surface b of impeller 45 engages the waste forcing it to the shredder ring 35. Impeller 46 on the other hand also rotates counterclockwise when rotor 44 moves in the direction of arrow 48. Therefore cutting surface d engages the waste with the shredder ring 35. It is to be seen that if cutouts 70 are viewed as "pointed fingers" then surface b on 64 is always facing the direction the finger is pointed. Note further that the impellers 45 and 46 are mounted in a mirror image relationship to each other. The total movement is seen therefore to be unidirectional in that the entering waste and water stream, and the impellers 45, 46 and the rotor 44 all move in the direction dictated by the movement of the rotor 44.

Blades 64, 66 and 68 may be precast and welded onto plate 60 or removable therefrom, if desired.

Before further describing the structure of each impeller 45, 46, a brief discussion of the operation of the rotor and impellers will be given. In operation, upon energization of motor 47, the rotor 44 is rotated in the direction of arrow 48 in FIG. 2. Due to centrifugal force the impellers 45, 46 will assume the position of FIG. 2, and upon impace with food will revolve about pins 58. Engagement of the cutting edges of impellers 45, 46 and any waste material between such cutting edges and the downwardly extending shredding elements 36 will result in comminution of the waste material. The waste, so comminuted, and any liquid will flow out apertures 54 and the spacing between elements 36 and rotor 44 to the discharge chamber 26.

If impellers 45, 46 encounter any waste material not easily comminuted or which would otherwise jam the assembly 43, the impellers 45, 46 rotate about their axes to allow the waste to move away from the impeller to a position where it may be comminuted by the other impeller.

On each impeller there are three blades, with four upstanding walls (the notches in 66 and 68 notwithstanding). Turning to main blade 64, the interfaces of the four vertical walls — a, b, c and d — are four (4) in number, and there are four interfaces between any one upstanding (vertical) wall and the top surface — the surface seen in FIG. 2. While all of the eight interfaces, four horizontal and four vertical, could be considered as cutting edges, applicant only considers the two upstanding interfaces, ab and ad per FIG. 4 or FIG. 2, to be actual cutting edges since the cutting is done in conjunction with the prebreakers primarily. Thus on clockwise rotation of impeller 46 in FIG. 2, the interface of ab would be an active edge, as a leading edge and on reversal of the motor, former trailing edge ad, now the leading edge, is the active cutting edge. If one considers 66 and 68 to be rectangular in shape, it is seen that they too have two (2) cutting edges each, though only one (1) is active per rotational direction. Thus three (3) blades x two (2) edges x two (2) impellers give rise to twelve (12) cutting edges per device. The blades 64, 66 and 68 may be either welded onto rotor 44, precast, upturned from rotor 44, or manufactured in any suitable manner. The impellers 45, 46 push the waste material toward ring 35 where it is comminuted. The impellers 45, 46 may be mounted on rotor 44 in a mirror image relationship, Such impellers may be manufactured in any suitable manner, such as forming similar base plates 60, then reversing one of the plates before securing the blades thereon. The mirror image relationship results in better agitation of the waste material and improved cutting action. As previously noted, although two impellers are shown, more than two may be provided. The interface ab as seen in FIG. 4 is denoted e in FIG. 5, while the interface ad of FIG. 4 is denoted as f in FIG. 5.

Although the smaller blades 66 and 68 do some comminuting or cutting of the waste material, they are provided to keep the waste material from rising up in the comminution chamber 11 when large objects, such as oranges or lemons, are placed in the disposer. If such rising up of waste takes place, such waste won't get ground up by the impeller blades. The smaller blades 66, 68 act to jam or force such waste against the shredder ring 35.

The disclosed disposer has an improved grinding action and can comminute waste material faster than conventional units due to its improved grinding action and movement of waste.

As can be seen in FIG. 2, blades 64 extend to prebreaker means 35' but blades 66, 68 are off-set a small distance, per FIG. 4, as distance X, from ring 35. This is because blade 64 is intended to be the main cutting blade and blades 66, 68 are not primarily intended (although they do some cutting) as cutting blades. This small space X, in case of a jamming up, aids in allowing free movement of the waste to unjam the disposer and allows slivers or the like to be pushed to the edge. The designation X is used since there is no criticality to the amount.

Figure 5:
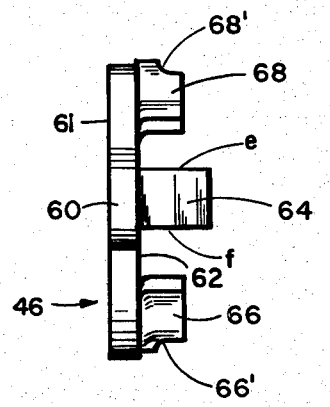
FIG. 5 is a side view of the impeller of FIG. 4.

As shown in FIG. 5, the smaller blades 66, 68 may be slightly undercut, or chamfered, at undercut sections 66', 68', to permit these blades to clear the prebreakers 35'. Such prebreakers 35' may be formed in any suitable manner, as, for example, by stamping portions 35' inwardly on ring 35.

It can be seen that there is disclosed a waste disposer having improved movement of waste therein and grinding action of the waste.

Base plates 60 may be any suitable configuration, but preferably include arcuate slots 70, each slot 70 having a first portion 71 opening out of the plate 60 adjacent each subsidiary cutting blade 66, 68 and a second portion 72 generally normal to portion 71 and extending slightly past each blade 66, 68. These slots serve to kick back any waste caught therein and increases the movement of the waste. Further, all the exposed edges of the base plate 60 may form cutting edges.

The use of free rotating impellers with improved grinding action enables the disposer to handle large quantities of waste without jamming.

The unique design of the impeller assembly of this invention which features diametrically opposed planetary grinding action acheives good cutting action on both soft and hard waste, as the term is known to the art. The complete rotatability of the impeller contributes to the minimization of jamming, since food particles that are caught will be hit on the next rotation of the impeller.

It has also been found advantageous to fabricate the main blade 64 as a separate part and then secure it to base plate 60, and to form the secondary blades 66 and 68 by upturning the two outstanding extremities of the base plate 60. Such a mode of manufacture reduces costs by eliminating a separate securing step for each of the secondary blades. The secondary blades may also be deemed subsidiary blades to the main cutting blades, 64.

It is also seen that with the impeller assembly and the waste disposer of this invention, that the grinding of any item or load of waste on a batch basis, will be carried out in the same time or perhaps a few seconds faster than prior art disposers. However, when waste is fed at a constant rate, i.e., continuous process, the instant unit will dispose of food faster due to the presence of more cutting areas or surfaces than prior art units.

Optionally, there may be included means to reverse the motor, as are known to the art, such that instead of having the turntable move in the direction of the arrow 48 on each grinding operation, the table will move in the direction of the arrow 48 on every other pass, and opposite to same on the intervening pass. Means for such automatic motor reversal are known sufficiently such as not to require a detailed discussion herein.

Although it has been disclosed in the preferred embodiment to employ the mirror image relationship of the two impellers 45 and 46, it is within the scope of this invention to use two or more for that matter similarly configured, non-mirror relationship assemblies. The mirror-image utilization was found to give rise to better cutting action and is preferred for that reason.

Since certain changes may be made in the above apparatus without departing from the scope of the invention herein involved, it is intended that all matter contained in the above description and shown in the accompanying drawings shall be interpreted as illustrative and not in a limiting sense.

I claim:

1. In a waste disposer including a housing providing a comminution chamber, an inlet in said housing for receiving waste material and fluid therein, shredding means within said comminution chamber, a rotary impeller assembly including a rotor and a plurality of impellers on said rotor within said comminution chamber, said impellers being adapted to cooperate with said shredding means upon rotation of said rotor for effecting comminution of said waste material, and drive means associated with said housing for selectively rotating said rotor, the improvement which comprises:

each of said impellers includes a base plate mounted for free rotation on said rotor, independent of the rotation of said rotor, each of said base plates including an upstanding main cutting blade having a plurality of cutting surfaces, and at least one secondary cutting blade of a size less than said main cutting blade also having a plurality of cutting surfaces, the main cutting blade and at least one secondary cutting blade being mounted on one of said base plates in a mirror image relationship to the main cutting blade and at least one secondary cutting blade mounted on the other of said plates so that as said rotor rotates, said impellers upon contact with waste material will rotate in an opposite direction relative to said rotor.

2. In the waste disposer of claim 1, further including means to reverse the direction of the movement of the motor automatically, upon each energization of said motor.

3. In the disposer of claim 1 wherein a second secondary cutting blade having a plurality of cutting edges thereon is provided of a size substantially the same as said first secondary cutting blade disposed between said main cutting blade and said first secondary cutting blade on each of said plates.

4. In the disposer of claim 3 wherein each of said blades are generally rectangular in cross-section, the exposed edges on each of said blades forming said cutting edges.

5. In the disposer of claim 4 wherein each of said main cutting blades on each of said plates has a substantially flat generally vertical surface generally coincident with the outer periphery of said rotor when said base plates rotate.

6. In the disposer of claim 5 wherein each of said secondary cutting blades on each of said plates has a substantially flat generally vertical surface offset from the outer periphery of said rotor when said base plates rotate.

7. In the disposer of claim 6 wherein said shredding means includes a generally annular shredding ring having a plurality of downwardly extending shredding elements cooperable with said main cutting blade to comminute waste between said main cutting blade and said shredding elements, waste prebreaking means formed on the inner wall of said ring for breaking up waste prior to engagement of said waste between said elements and said main cutting blade and chamfer means on said secondary cutting blades for bypassing said prebreaking means when said secondary cutting blades move past said prebreaking means.

8. In the disposer of claim 6 wherein arcuate slots are provided in said base plate adjacent each of said secondary cutting blades extending from the outer periphery of said base plate to a point between said secondary cutting blades and the axes of revolution of said base plate on said rotor for kicking any waste encountered by said slot away from said plate so as to continually move said waste in said comminution chamber when said rotor is rotated.

9. In the disposer of claim 8 wherein each of said slots includes a first portion opening from the interior of said base plate to the exterior thereof and a second portion extending generally normal to said first portion of each of said slots, said second portions extending past said secondary cutting blades, each of said secondary cutting blades having a generally vertical surface facing said first portion of each of said slots.

10. In the disposer of claim 6 wherein the cutting edges of each of said secondary blades adjacent the outer periphery of said base plate are generally flush with the outer periphery of said base plate.

11. A rotary impeller assembly for use in a comminution chamber comprising a plurality of impellers positioned on a rotor, said impellers being adapted to cooperate with a shredding means, each of said impellers including a base plate mounted for free rotation on said rotor, independent of the rotation of said rotor, each of said base plates having an upstanding main cutting blade having a plurality of cutting surfaces, and at least two secondary cutting blades of a size less than said main cutting blade, and also having a plurality of cutting surfaces each, all of said blades being mounted on said base plates.

12. The impeller assembly of claim 11, wherein the main cutting blade and the secondary blades are mounted on one of said base plates in a mirror image relationship to the main cutting blade and the secondary blades mounted on the other of said plates such that as said rotary rotates said impellers upon contact with waste material will rotate in an opposite direction relative to said rotor.

13. The impeller assembly of claim 11 wherein each of said blades is generally rectangular in cross-section, and said secondary blades are undercut at the top outer edge thereof.

14. The impeller assembly of claim 13 wherein two impellers are positioned on a rotor, and further wherein the main cutting blade and the secondary blades of one impeller are mounted on its base plate in a mirror image relationship to the main cutting blade and secondary blades mounted on the other base plate.

15. In the rotary assembly of claim 11 wherein each impeller, including the base plate and the blades, is formed as one piece.

* * * * *